US005526611A

United States Patent [19]

Leahy

[11] Patent Number: 5,526,611

[45] Date of Patent: Jun. 18, 1996

[54] SELF-RIGHTING GUTTER SYSTEM

[76] Inventor: Kevin N. Leahy, 280 Kerrwood Dr., Wayne, Pa. 19087

[21] Appl. No.: 469,816

[22] Filed: Jun. 6, 1995

Related U.S. Application Data

[63] Continuation-in-part of Ser. No. 257,137, Jun. 9, 1994.

[51] Int. Cl.[6] ..... E04D 13/00

[52] U.S. Cl. ..... 52/11; 52/16

[58] Field of Search ..... 52/11, 12, 13, 52/14, 15, 16; 248/48.1, 48.2

[56] References Cited

U.S. PATENT DOCUMENTS 3,077,055 2/1963 Tripp, Jr. .
4,117,635 10/1978 Nelson .
4,411,108 10/1983 Kerester .
4,807,406 2/1989 Densmore .

*Primary Examiner*—Creighton Smith
*Attorney, Agent, or Firm*—Staas & Halsey

[57] ABSTRACT

A self-righting gutter system for a structure. Supports mounted to the structure support a gutter. The gutter can rotate from a first water collecting position to a second cleaning position and self-rights to the first water collecting position. The gutter has a greater thickness along a longitudinal axis thereof. The gutter may be rotated, for example, by using a cable, connected to the gutter or by using a properly weighted pole with a hook by standing on the ground. The gutter returns to the water-collecting position or self-rights by letting go of the cable or by removing the pole from the hook, that is, the variable thickness and corresponding weight of the gutter along the axis, i.e. the center of gravity of the gutter, wants to return to its original position.

22 Claims, 20 Drawing Sheets

SELF-RIGHTING GUTTER SYSTEM

This application is a continuation-in-part of application Ser. No. 08/257,137, filed Jun. 9, 1994, now pending.

BACKGROUND OF THE INVENTION

1. Field of the Invention

The present invention relates generally to a self-righting gutter system for a house, building, structure, etc., which facilitates cleaning of a gutter, and more particularly to a self-righting gutter system in which the gutter rotates from a first position for collecting water to a second position for cleaning, and which self-rights from the second cleaning position to the first water collecting position.

2. Description of the Prior Art

Gutters are employed to catch water run off from roofs of building structures, particularly roofs of houses, to prevent erosion of the soil adjacent to the structure and to prevent damage to the foundation of the structure. However, the accumulation of debris, such as leaves, often clogs the gutter, and the water, which normally flows through the gutter, overflows down the side of the structure causing damage. Further, weather conditions often pile up ice and snow in the gutter so that water run-off is impeded resulting in leakage through the roof to the interior, and gradual rotting of the roof material and innerstructure. In addition, the weight of the ice often damages the gutter itself, and seriously weakens its attachment to the structure.

Removal of such accumulated debris restores proper drainage and protects the roof and structure. Although cleaning of the gutter may be accomplished manually by an individual on a ladder, this may be dangerous, particularly to an inexperienced homeowner.

In the prior art, there are rotatable gutter systems. However, these prior art gutter systems involve the use of complex mechanical devices such as pulleys, rods, gears, hand cranks, electric motors, etc. These complex electrical/mechanical prior art gutter systems are difficult to maintain, difficult to install and prohibitively expensive. In addition, the prior art gutter systems are exposed to natural elements causing failure thereof.

Therefore, there is a demand for a gutter system that is reliable, simple and inexpensive to manufacture; is relatively easy to install; requires minimal maintenance; and may be easily and safely cleaned by an operator.

SUMMARY OF THE INVENTION

Accordingly, it is an object of the present invention to provide a novel self-righting gutter system which alleviates the aforesaid problems.

Another object of the present invention is to provide a self-righting gutter system that eliminates the danger involved in cleaning gutters.

A further object of the present invention is to provide a self-righting gutter system which is simple and economical to manufacture, easy to install, easy to maintain and easy to operate.

To achieve the foregoing and other objects of the present invention there is provided a self-righting gutter system connected to a building structure for directing water from the roof and away from the structure. The gutter is received in supports that allow rotation of the gutter along its longitudinal axis between a water collecting position and a cleaning position. The gutter has edges, a center and a thickness which decreases from the center to the edges. The weight of the gutter also decreases from the center to the edges. Thus, the gutter has a center of gravity located at approximately the center of the gutter. An operator rotates the gutter utilizing, for example, either a cable or a weighted, hooked pole, connected to the gutter. By applying a downward force on the gutter using the cable or pole, the gutter is rotated from the normal water-collecting position to the cleaning position. After cleaning, the downward force is released and the gutter automatically returns to the water-collecting position due to the center of gravity of the gutter wanting to return to its original position.

The above-mentioned and other objects and features of the present invention will become more apparent from the following description when read in conjunction with the accompanying drawings, in which like reference characters designate the same or similar parts throughout the figures thereof. However, the drawings and description are merely illustrative in nature and not restrictive.

DETAILED DESCRIPTION OF THE PREFERRED EMBODIMENT

Figure 1:
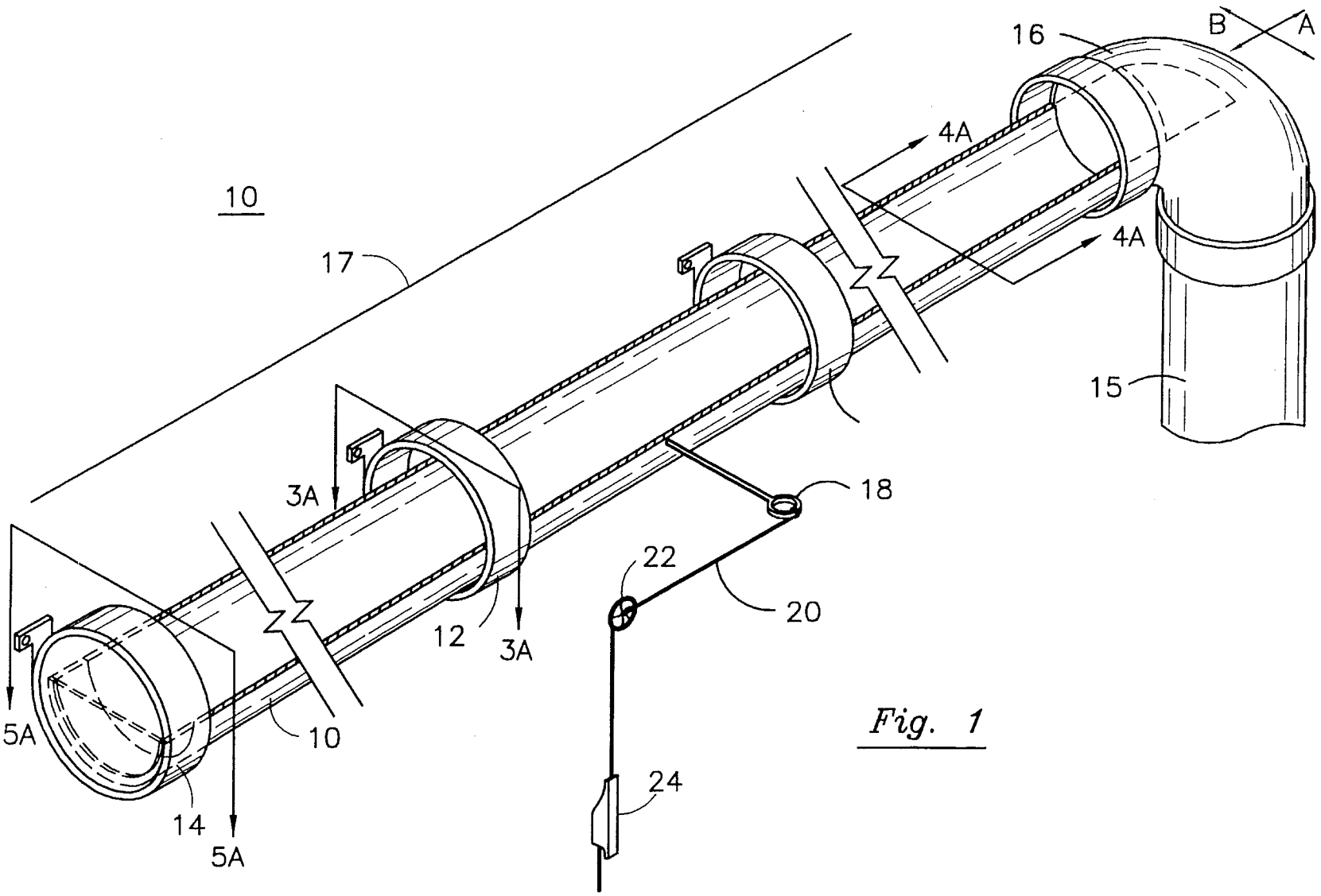
FIG. 1 is a perspective view of a first embodiment of the gutter system according to the present invention.
Figure 2:
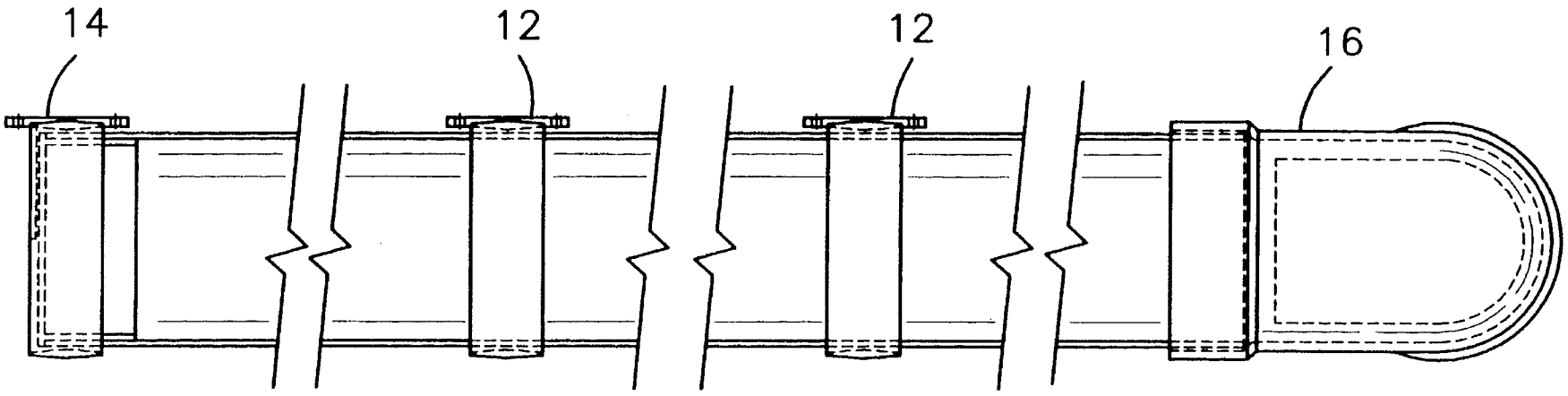
FIG. 2 is a plan view of the first embodiment shown in FIG. 1.

FIG. 1 is a perspective view of a first embodiment of the self-righting gutter system 1, while FIG. 2 is a plan view of same. As shown therein a gutter 10 is supported, for example, by supports 12 placed intermediately of the ends of the gutter 10, an end stop support 14 placed at one end of the gutter 10 and an elbow 16 placed at the opposite end of the gutter 10. The elbow 16 is attached to a downspout 15. The elbow 16 may be closed or open as shown in phantom lines in FIGS. 1 and 2 to collect water. The end stop support 14 and the elbow 16 prevent the gutter 10 from sliding along axis A. The gutter 10, intermediate supports 12, end stop support 14 and elbow 16 one preferably manufactured each as one-piece from PVC, plastic or any other weather resistant material.

Figure 3C:
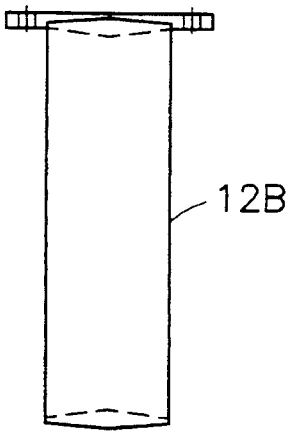
FIG. 3C is a plan view of the intermediate support shown in FIG. 1.
Figure 3A:
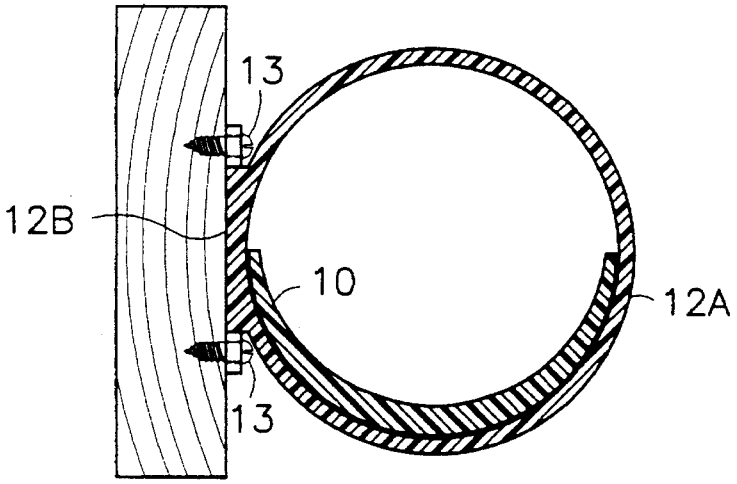
FIG. 3A is a cross-sectional view of a first embodiment of an intermediate support for the system taken along line 3A—3A of FIG. 1.

The intermediate supports 12, end stop support 14 and elbow 16 may be attached under a roof ledge of a structure 17 using anchors, nails, screws, etc. 13 (FIG. 3A). A connection 18 is mounted to the gutter 10. In this preferred embodiment, the connector 18 is a hook. As described in greater detail below, a cable 20 can be tied to the hook 18, passed through a hole 22 in the structure 17, and cleated in a cleat 24 located inside the structure.

Figure 3B:
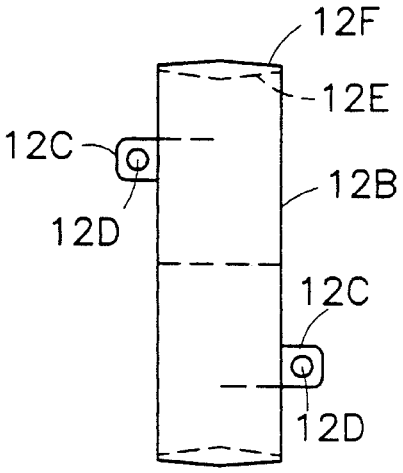
FIG. 3B is an elevational view of the intermediate support shown in FIG 1.

FIG. 3A is a cross-sectional view of the supports 12 intermediate of the ends of the gutter 10 shown in FIGS. 2 and 3. The intermediate supports 12 include a section 12A, preferably curved, for rotatably supporting the gutter 10 and a section 12B, preferably rectangular, with protrusions 12C having holes 12D. The screws, nails, tacks, etc. 13 fasten the intermediate supports 12, to the structure through the holes 12D as shown in the elevational view in FIG. 3B. FIG. 3C is a plan view of the intermediate supports 12.

Although the curved section 12A of the intermediate supports 12 may have the same thickness, it is preferable to manufacture the supports 12 so that the thickness of the middle 12E is greater than the thickness of the edges 12F of the supports 12, i.e. includes a protrusion. This can be in the form of a triangular cross section of the supports 12 as shown in FIG. 3B. This feature reduces the friction during rotation of the gutter 10 on the intermediate supports 12, where the gutter 10 sits on the supports 12. This feature also improves the aesthetic appearance of the gutter system.

Figure 4:
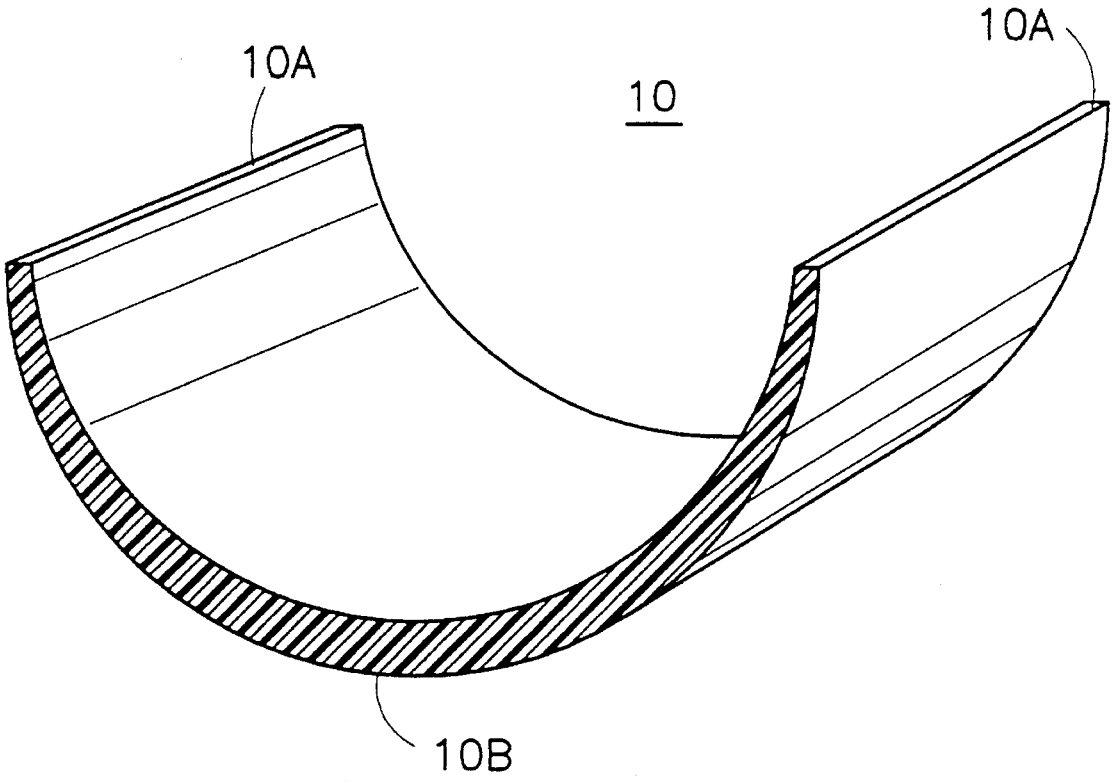
FIG. 4 is a cross-sectional view of the gutter of the system taken along 4A—4A of FIG. 1.

FIG. 4 is a cross section of the gutter 10. The gutter 10 includes edges 10A and a center 10B. As shown in FIG. 4, the thickness of the gutter 10 from the center 10B to each edge 10A decreases. This causes the weight of the gutter 10 to be greater at the center 10B of the gutter 10, i.e., the center of gravity is near the center 10B.

Figure 5C:
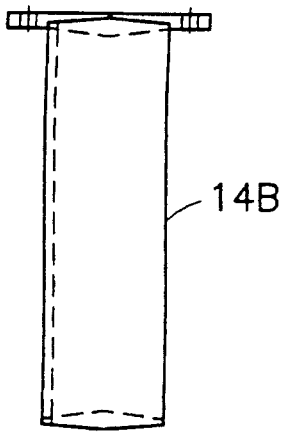
FIG. 5C is a plan view of the end stop support shown in FIG. 5A.
Figure 5A:
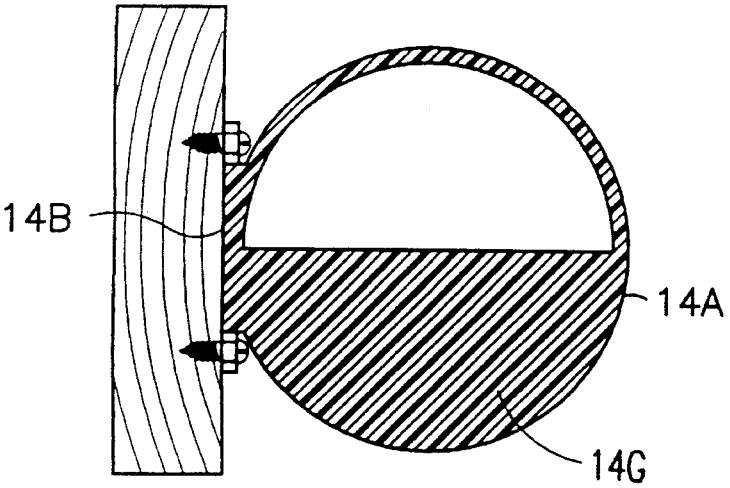
FIG. 5A is a cross-sectional view of an end stop support.
Figure 5B:
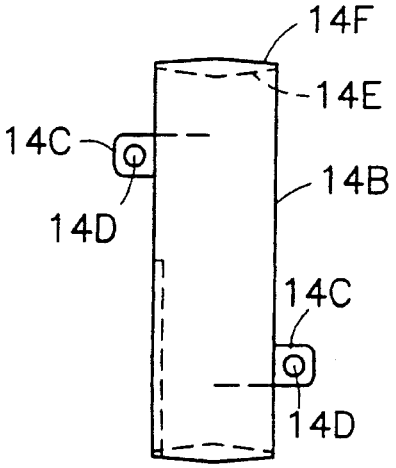
FIG. 5B is an elevational view of the end stop support shown in FIG. 5A taken along line 5A—5A of FIG. 1.

FIG. 5A shows an end stop support 14, which is similar to the intermediate supports 12, except that the end stop support 14 includes an additional flat circular end section 14G to prevent the gutter 10 from sliding along axis A. Like support 12, the end stop support 14 includes a section 14A, preferably circular, for supporting the gutter and a section 14B, preferably rectangular, with protrusions 14C having holes 14D. Screws, nails, tacks, etc. 13 fasten the end stop support 14 to the structure 17 through the holes 14D as shown in FIG. 5B.

The end stop support 14 may also be manufactured so that the thickness of the middle 14E is greater than the thickness of the edges 14F to provide a protrusion to reduce friction with the gutter 10 and improve appearance.

Figure 6:
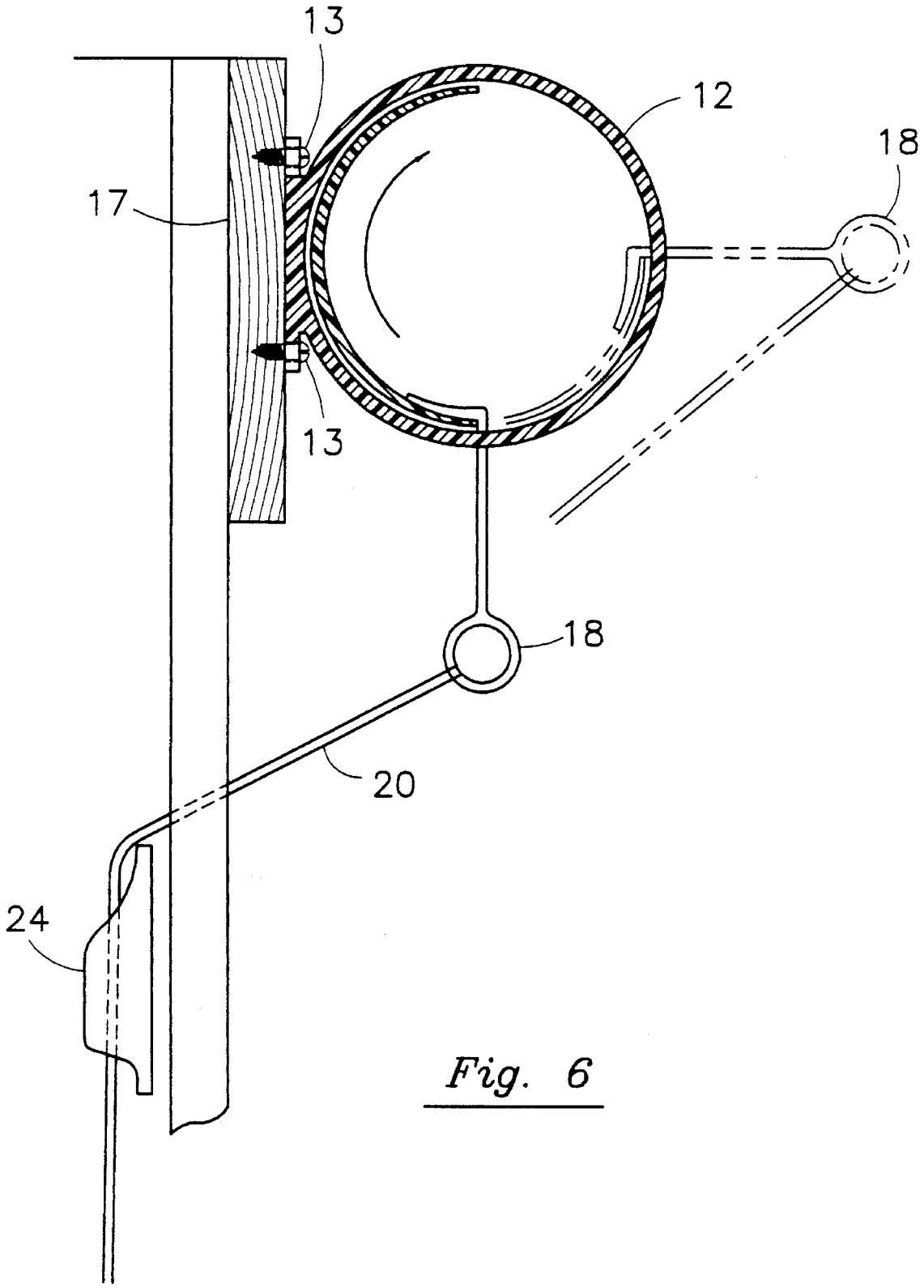
FIG. 6 is a side, partial cross-sectional view illustrating the rotation of the gutter from a first water collecting position to a second cleaning position, shown in FIG. 1 using a cable.

FIG. 6 shows operation of the first embodiment of the self-righting gutter system 1 using a cable 20. Normally, the gutter 10 is in a first upright position to collect water. When the operator wishes to clean the gutter 10, the operator uncleats the cable 20, pulls the cable 20 which puts downward pressure on the gutter 10 and rotates the gutter 10 to a second cleaning position, and cleats the cable 20 in the cleat 24 to hold the gutter 10 in the rotated cleaning position. In the cleaning position, all the debris should fall to the ground. However, water from a hose may be applied to the gutter 10 to remove any remaining debris. After cleaning is completed, an operator uncleats the cable 20 and releases the cable 20. At this point, the gutter 10 self-rights to the original, first water-collecting position.

That is, since the thickness of the gutter 10 at the center 10B is greater than the thickness at the gutter edges 10A, the weight of the gutter 10 at the center 10B is greater than the weight of the gutter at the edges 10A. When the heavier center 10B is rotated to a position that is other than at the bottom of the system 1, the center 10B wants to return to its original position when the pressure is released wherein the gutter rotates back to its original water collecting position. This is the self-righting feature of the gutter system 1.

Figure 7:
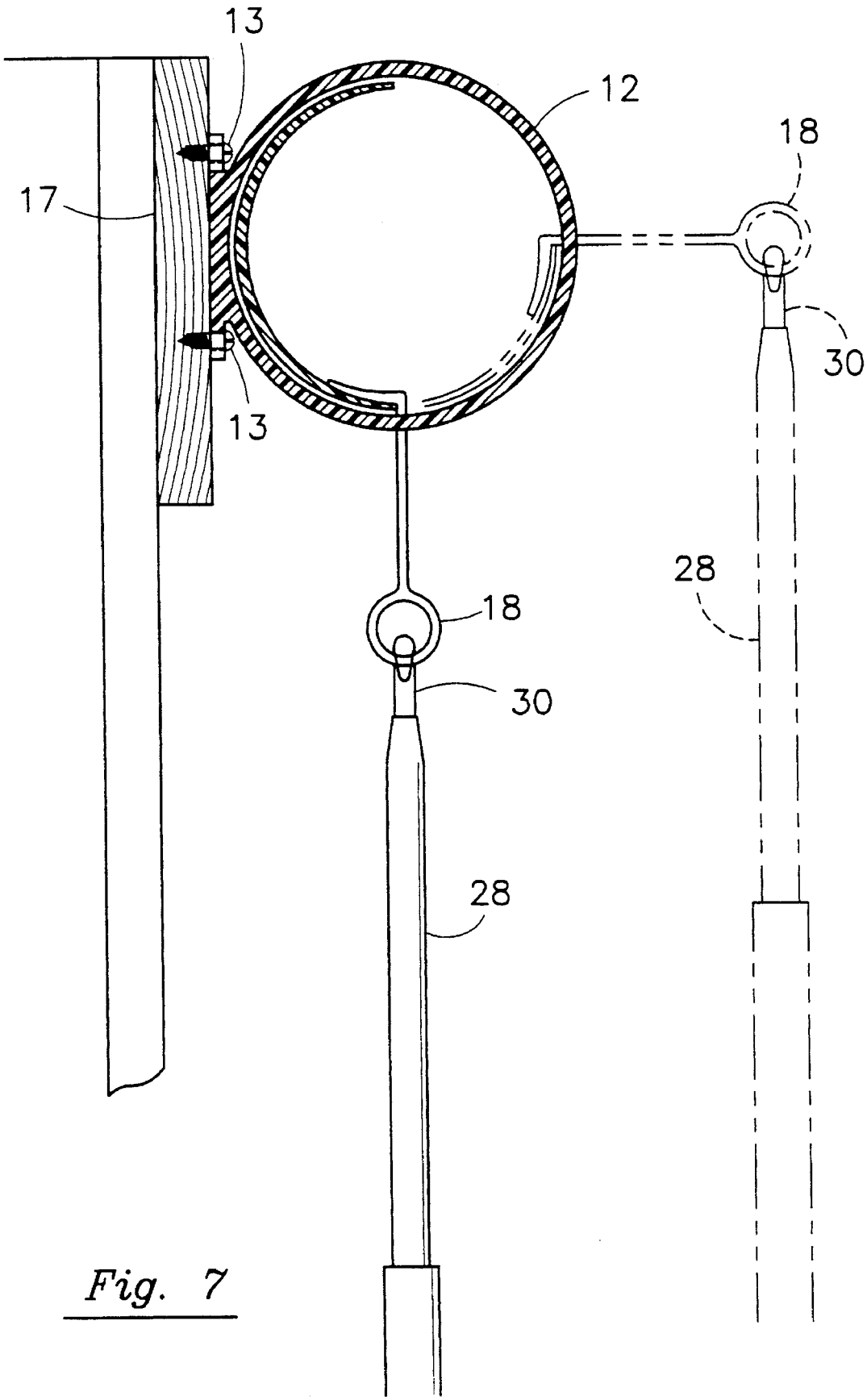
FIG. 7 is a side, partial cross-sectional view illustrating similar rotation of the gutter shown in FIG. 1, but using a pole.

FIG. 7 shows another way of rotating the gutter of the present invention. In this version, the cable 20 is replaced by a weighted pole 28 having a hook 30. Normally, the gutter 10 is in the first position to collect water. An operator standing on the ground connects the hook 30 to the hook 18. The operator then releases the pole 28 and the weight of the pole 28 causes the gutter 10 to rotate to the second position so that the gutter 10 may again be cleaned. The pole 28 is properly weighted to rotate the gutter 10 without placing a great deal of stress on the gutter 10. By removing the hook 30 after cleaning, the gutter 10 self-rights to the original, first water-collecting position because the thickness of the gutter 10 at the center 10B of the gutter 10, and its corresponding weight is greater than at the edges 10A of the gutter 10. Although the weight of the pole 28 causes the rotation of the gutter 10 from the water collecting position to the cleaning position, any device producing a downward force could be utilized.

Figure 8B:
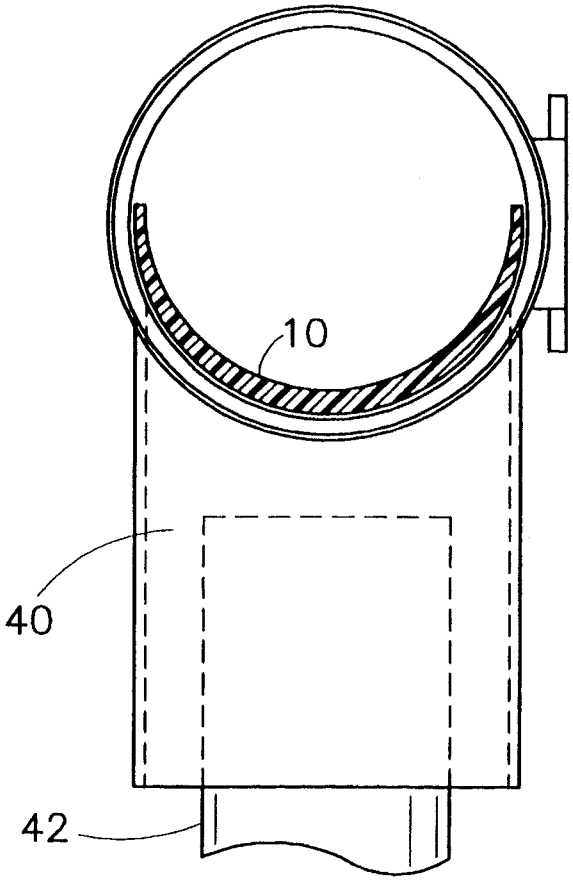
FIG. 8B is a cross-sectional view of the T support member shown in FIG. 8A.
Figure 8A:
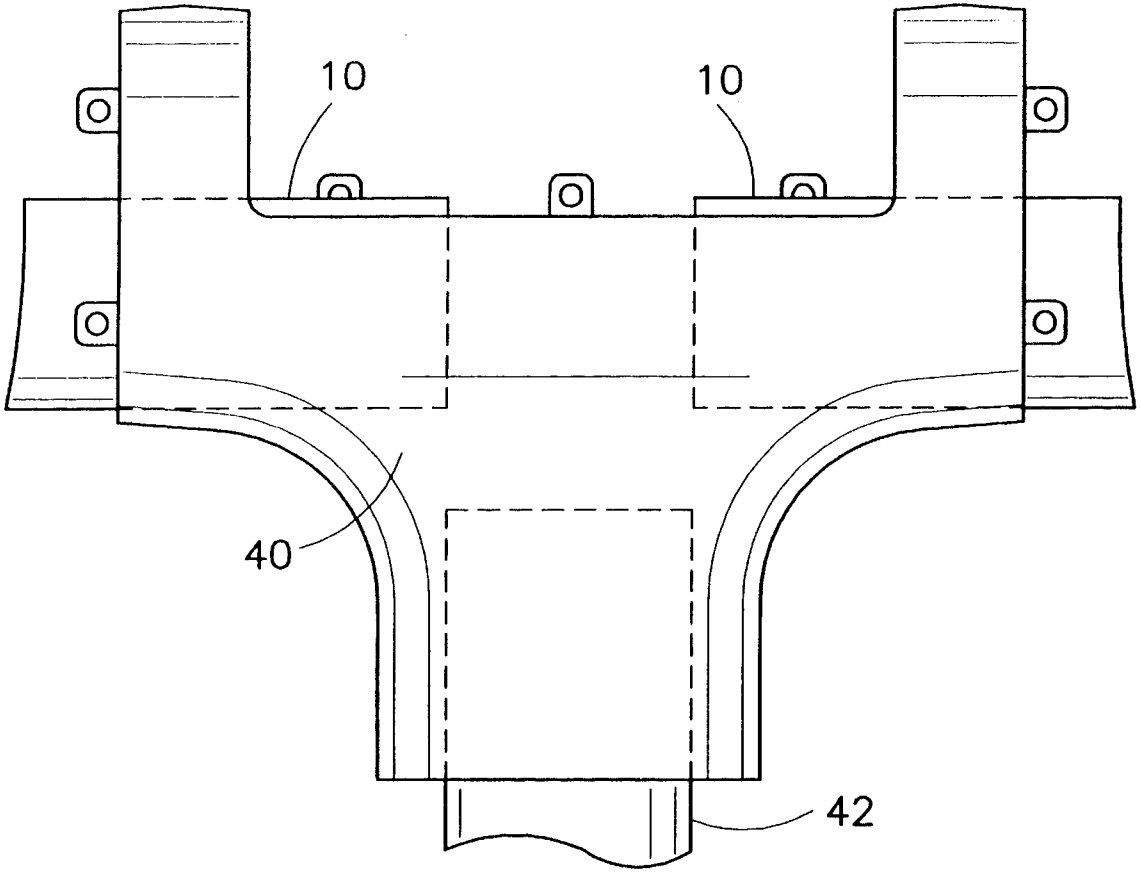
FIG. 8A is an elevational view of a "T" support member connecting two gutters.

FIGS. 8A and 8B show a "T" support 40 which connects two gutters 10 and which connects to a down spout support 42. The T is shown open to collect water, but could be closed. The T may be substituted for the elbow 16. The gutters would be cleaned independently in the same fashion as shown in FIG. 6.

Figure 9:
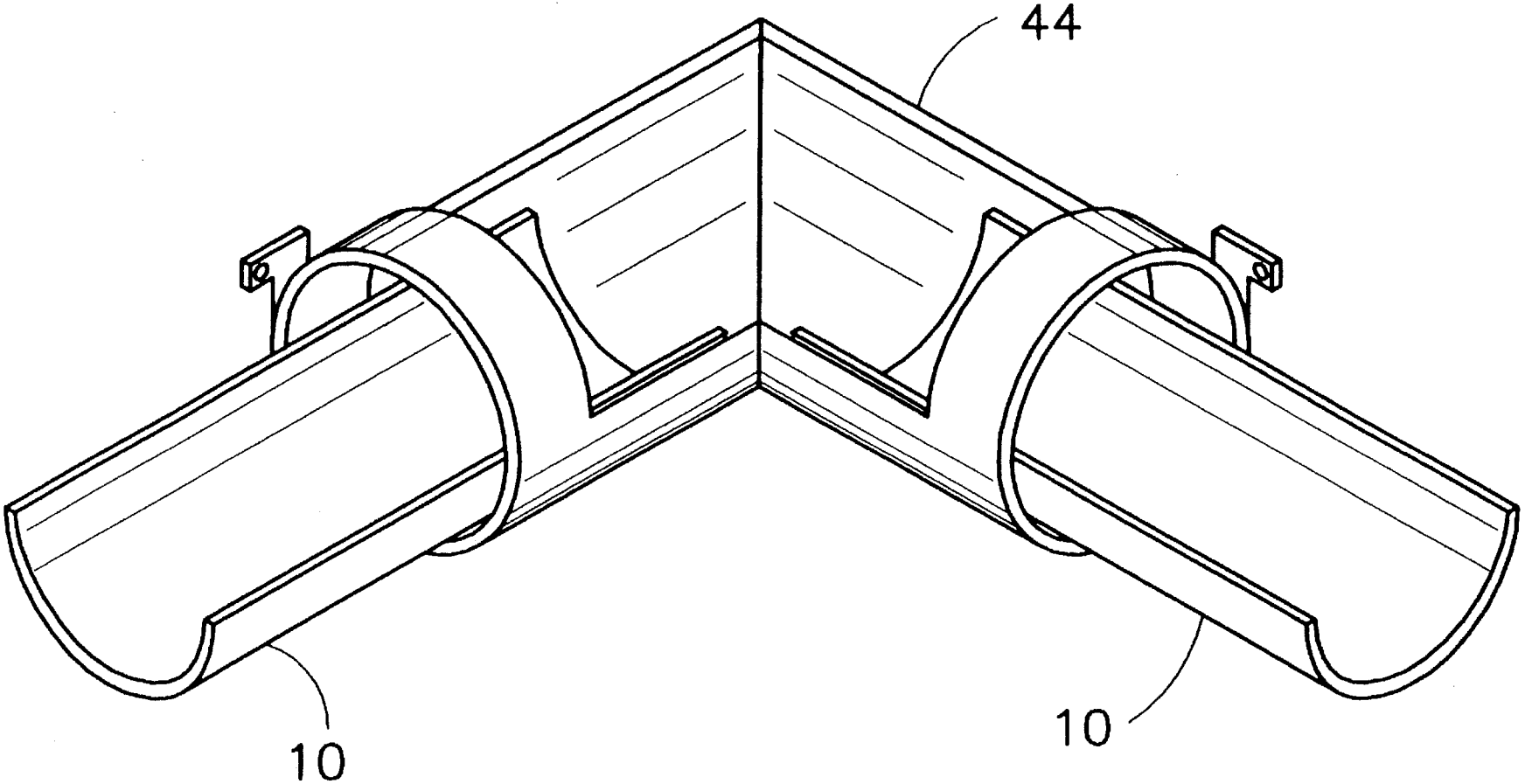
FIG. 9 is a perspective view of a corner support member for connecting two gutters.

FIG. 9 is a perspective view of a support corner 44 of a structure for collecting water.

Figure 10:
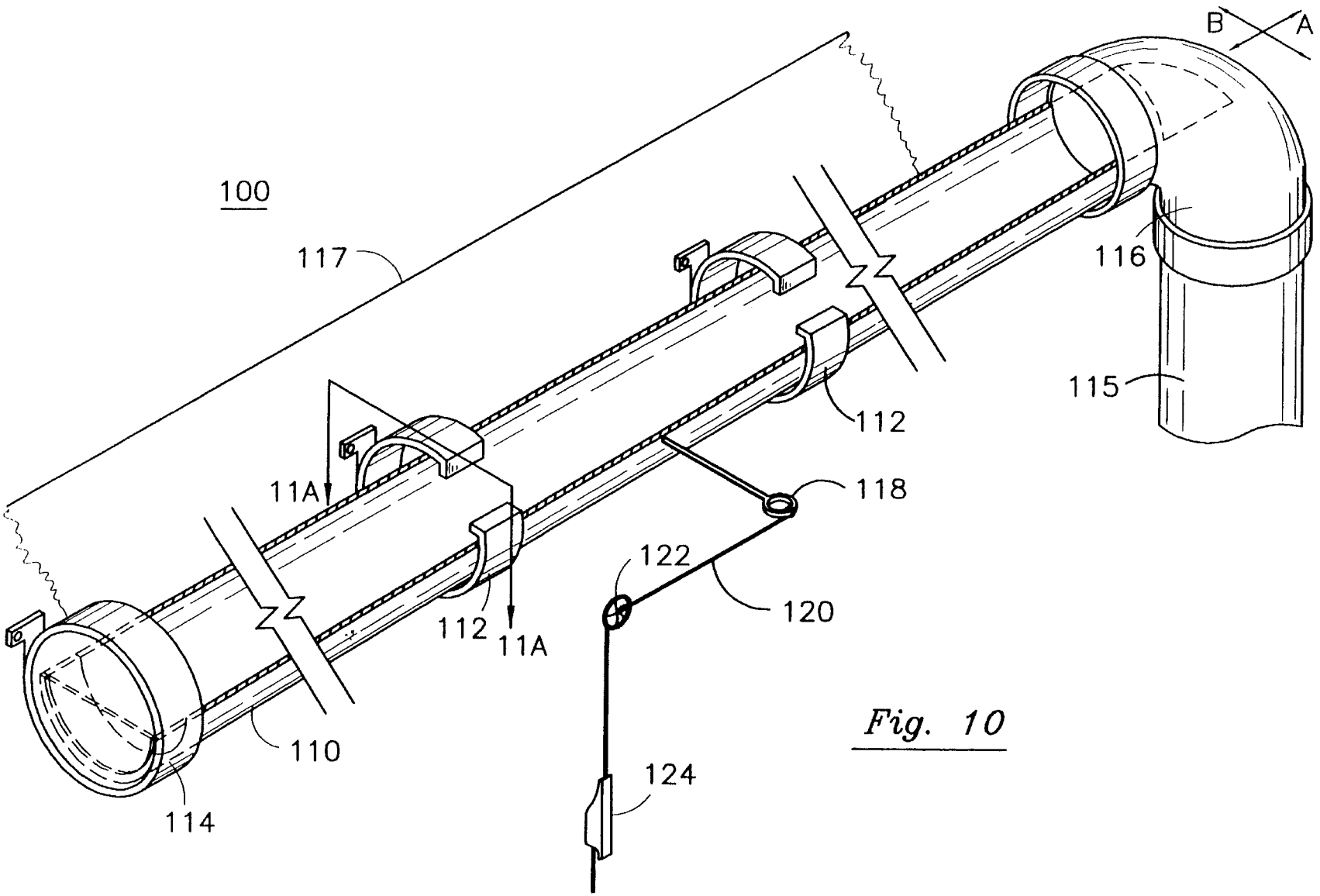
FIG. 10 is a perspective view of a second embodiment of the present invention.

FIG. 10 is a perspective view of a second embodiment of a self-righting gutter system 100 according to this invention. A gutter 110 is supported, for example, by supports 112 placed intermediately of the ends of the gutter 110, an end stop support 114 and an elbow 116. The elbow 116 is attached to a downspout 115. The gutter 110 of this embodiment is identical to the gutter 10 of the first embodiment of the present invention shown in FIGS. 1 and 4 particularly. The end stop support 114 and the elbow 116 prevent the gutter 110 from sliding along axis support A. The gutter 110, intermediate supports 112 and elbow 116 may be manufactured from PVC, plastic or any other weather resistant material.

The intermediate supports 112, end stop support 114 and elbow 116 may be attached under the roof ledge of a structure 117 using anchors, nails, screws, etc. 113. A connector 118 such as a hook 118 is mounted to the gutter 110. A cable 120 is tied to the hook 118, passed through a hole 122 in the structure 117 and is cleated in a cleat 124 located inside the structure. The elbow 116 may be closed or open to collect water. The intermediate supports 112, end stop 114 and elbow 116 maybe attached under a roof ledge of a structure 117 using anchors, nails, screws, etc. 113 (FIG. 11A).

Figure 11C:
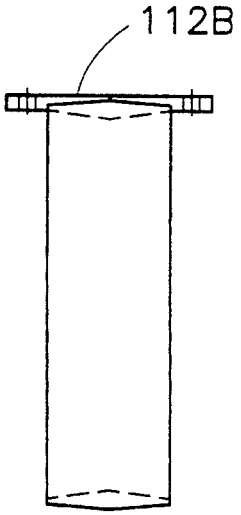
FIG. 11C is a plan view of the intermediate support shown in FIG. 10.
Figure 11A:
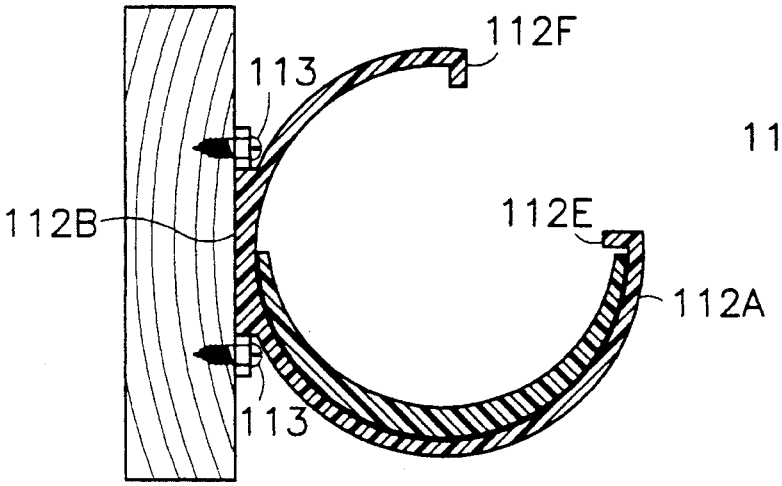
FIG. 11A is a cross-sectional view of a second embodiment of an intermediate support taken along line 11A—11A of FIG. 10.
Figure 11B:
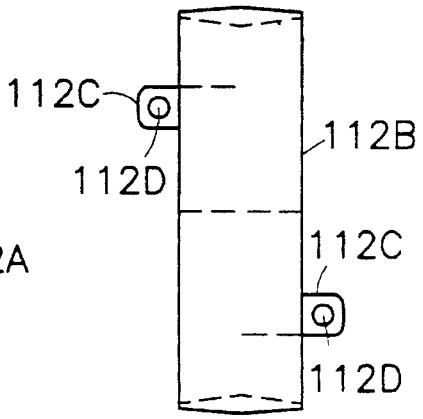
FIG. 11B is an elevational view of the intermediate support shown in FIG. 10.

As shown more particularly in FIGS. 11A–11C, the intermediate supports 112 include a section 112A preferably curved for rotatably supporting the gutter 110 and a section 112B preferably rectangular with protrusions 112C having holes 112D as shown in FIG. 11B. The curved section 112A terminates at stops 112E and 112F. When the gutter 110 is in the first water-collecting position, stop 112E tends to hold the gutter 110 in the water-collection position. When the gutter 110 is rotated to the cleaning position, stop 112F tends to prevent the gutter from rotating too far.

Figure 12:
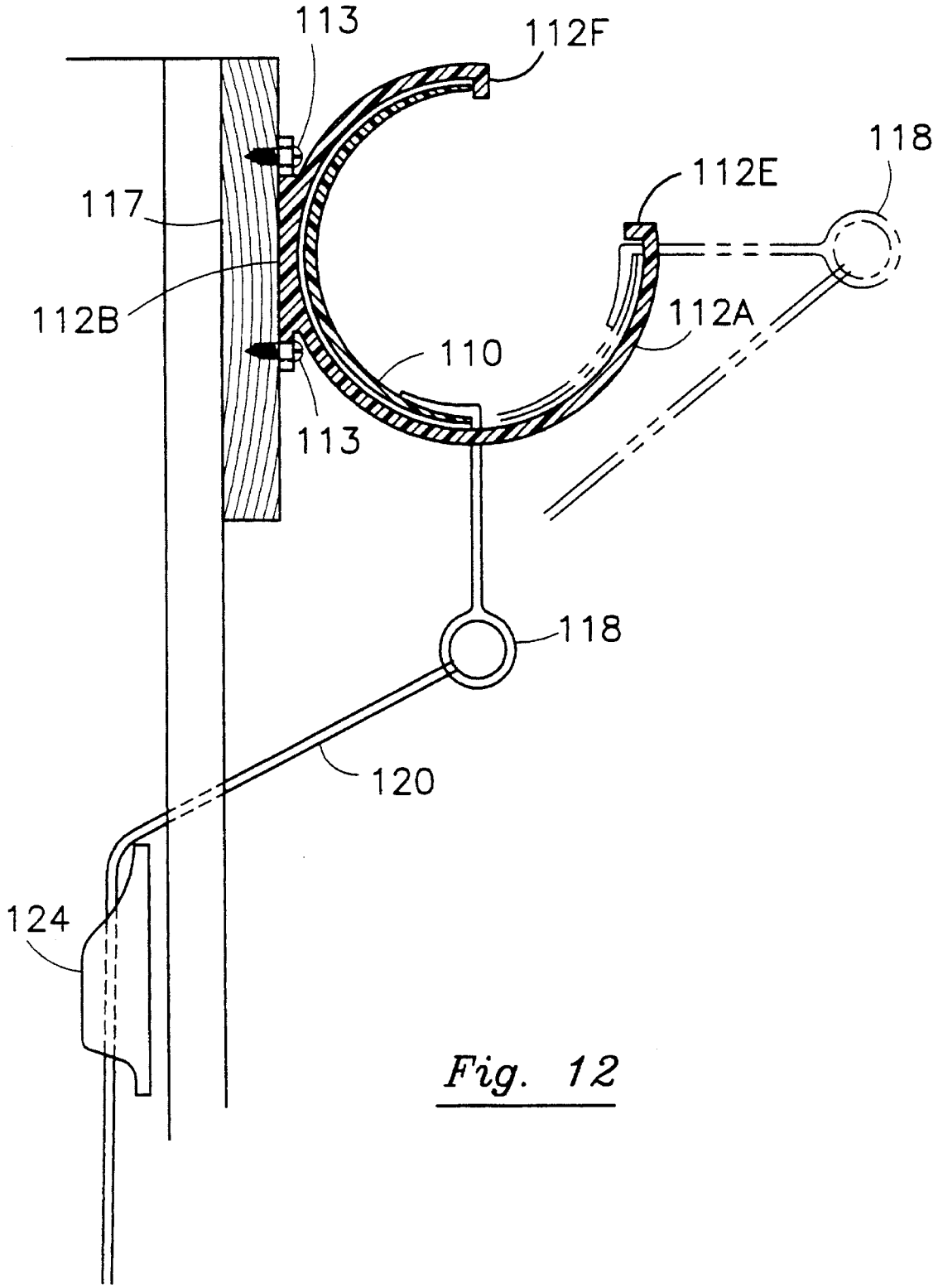
FIG. 12 is a side, partial cross-sectional view illustrating the rotation of the gutter shown in FIG. 10 using a cable.

FIG. 12 shows a partial cross section of operation of the self-righting gutter system 100. Normally, the gutter 110 is in an upright position to collect water. When the operator wishes to clean the gutter 110, the operator uncleats and pulls the cable 120 to rotate the gutter 110 in the cleaning position. The operator then cleats the cable 120 in the cleat 124. In the cleaning position, all the debris should fall to the ground. However, water from a hose may be applied to the gutter 110 to remove debris, which has not fallen to the ground. After cleaning is completed, an operator uncleats the cable 120 and releases the cable 120 until the gutter 110 self-rights to the water collecting position, as described above. The operator then cleats the cable 120 in the cleat 124.

Figure 13:
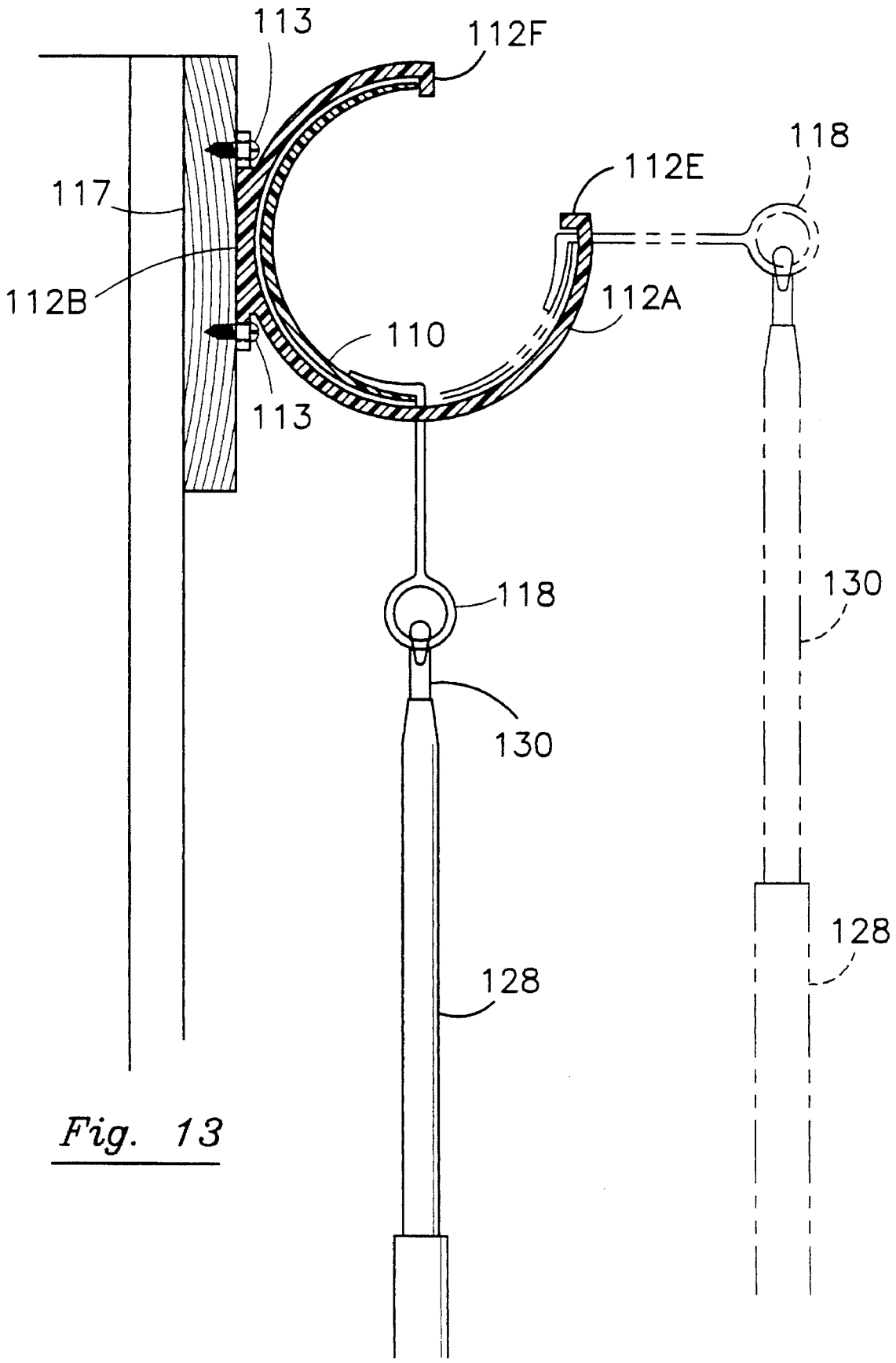
FIG. 13 is a side, partial cross-sectional view illustrating similar rotation of the gutter shown in FIG. 10 using a pole.

FIG. 13 shows an alternate way of rotating the gutter 110 of the second embodiment. The cable 120 is replaced by a weighted pole 128 having hook 130. Normally, the gutter 110 is in a position to collect water. An operator standing on the ground places the hook 130 through the hook 118. Once the operator releases the pole 128, the weight of the pole causes the gutter 110 to rotate so that the gutter 110 may be cleaned. The pole 128 is properly weighted to rotate the gutter 110 without placing a great deal of stress on the gutter 110. By removing the hook 130 after cleaning, the gutter 110 self-rights to the water-collecting position.

Figure 14:
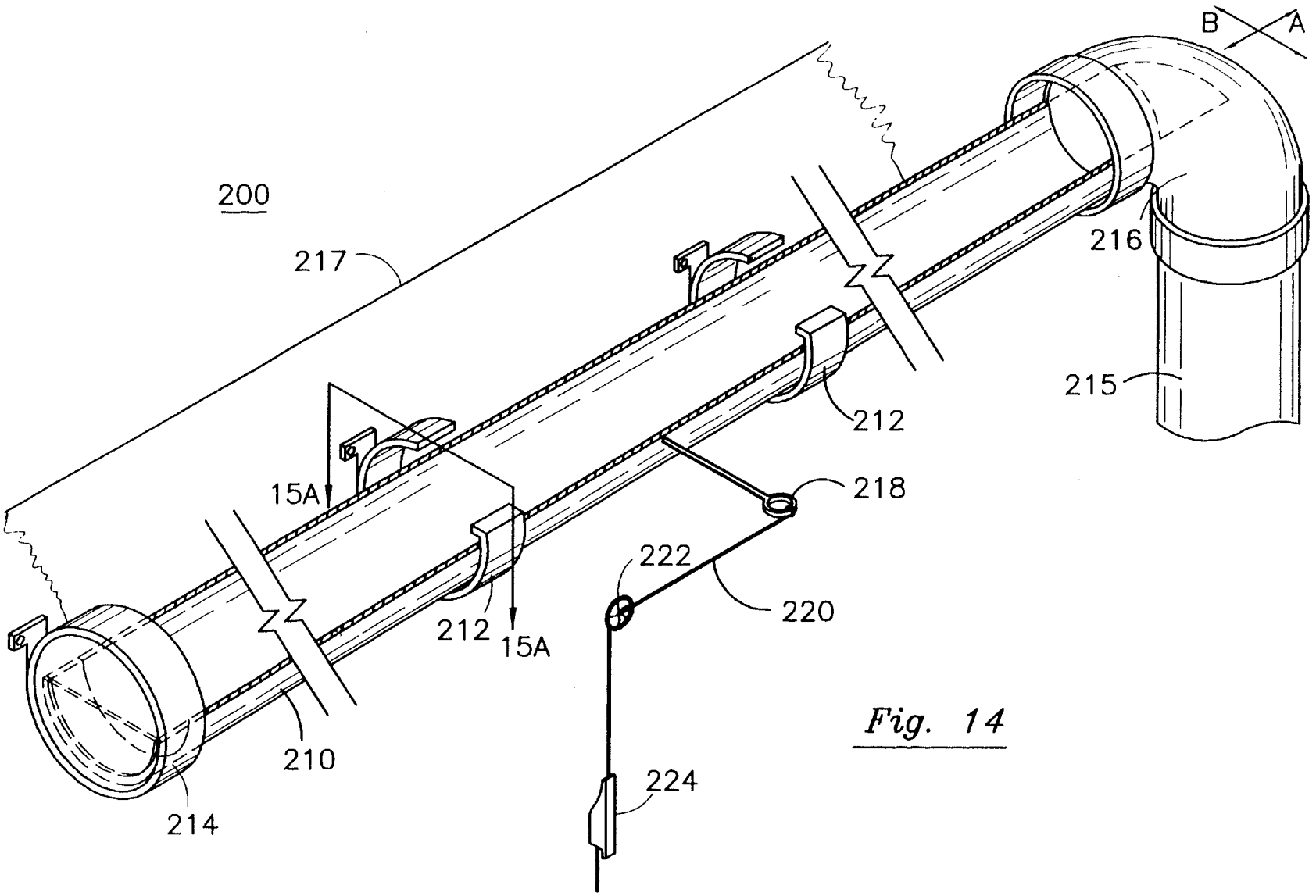
FIG. 14 is a perspective view of a third embodiment of the gutter system according to the present invention.

FIG. 14 is a perspective view of a third embodiment of the self-righting gutter system 200. A gutter 210 is supported, for example, by intermediate supports 212, an end stop 214 and an elbow 216. The elbow 216 is attached to a downspout 215. The gutter 210 is identical to the gutters 10 and 110 of the first and second embodiments of the present invention. The end stop 214 and the elbow 216 prevent the gutter 210 from sliding along axis A. The gutter 210, intermediate supports 212 and elbow 216 may be manufactured from PVC, plastic or any other weather resistant material.

The supports 212, end stop 214 and elbow 216 may be attached under the roof of a structure 217 using anchors, nails, screws, etc. 213. A hook 218 is mounted to the gutter 210. A cable 220 is tied to the hook 218, passed through a hole 222 in the structure 217 and is cleated in a cleat 224 located inside the structure. The elbow 216 may be closed or open to collect water. The intermediate supports 212, end support 214 and elbow 216 may be attached under a roof ledge of structure 217 using anchors, nails, screws, etc. 213 (FIG. 15A).

Figure 15C:
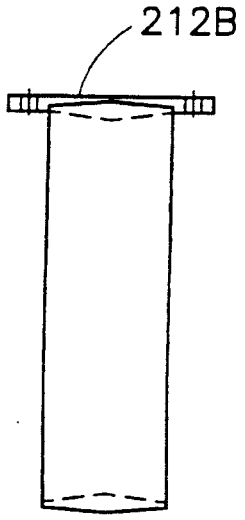
FIG. 15C is a plan view of the intermediate support shown in FIG. 14.
Figure 15A:
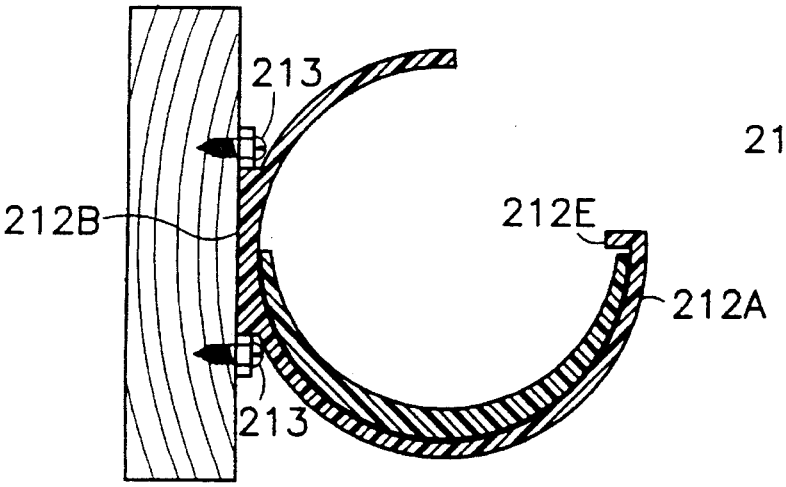
FIG. 15A is a cross-sectional view of a third embodiment of an intermediate support taken along line 15A—15A of FIG. 14.
Figure 15B:
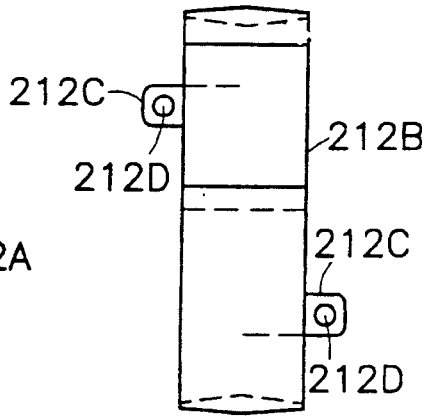
FIG. 15B is an elevational view of the intermediate support shown in FIG. 14.

As shown in FIGS. 15A–15C, the intermediate supports 212 include a section 212A that is preferably curved for supporting the gutter 210 and a rectangular section 212B with protrusions 212C having holes 212D. The curved section 212A connects to a single stop 212E which tends to hold the gutter 210 in the water-collecting position.

Figure 16:
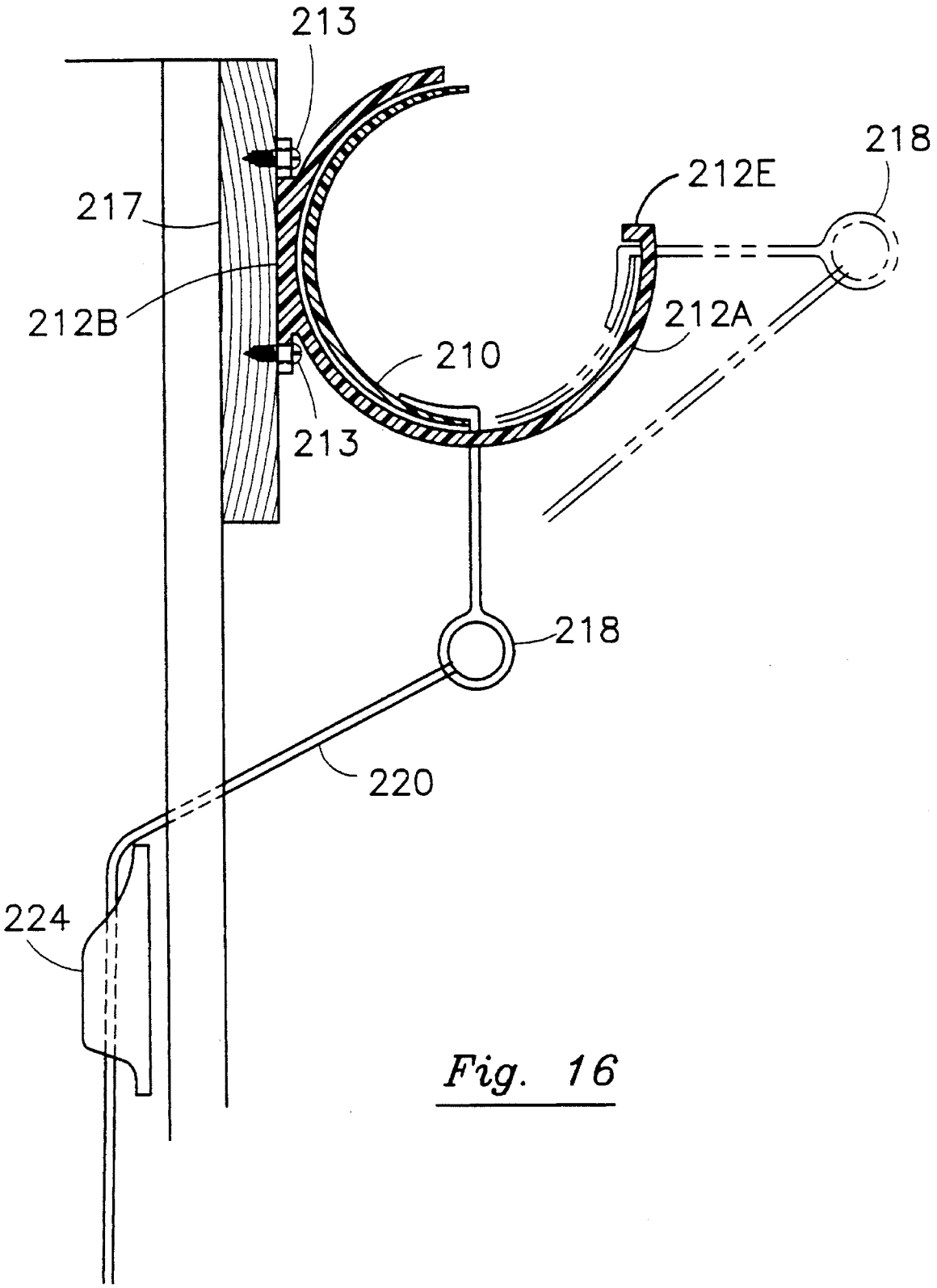
FIG. 16 is a side, partial cross-sectional view illustrating the rotation of the gutter shown in FIG. 14 using a cable.

FIG. 16 shows a partial cross section of operating the self-righting gutter system 200. Normally, the gutter 210 is in an upright position to collect water. When the operator wishes to clean the gutter 210, the operator pulls the cable 220 to place the gutter 210 in the rotated cleaning position. In the cleaning position, all the debris should fall to the ground. However, water from a hose may be applied to the gutter 210 to remove debris, which has not fallen to the ground. After cleaning is completed, an operator uncleats the cable 120 and releases the cable 220 until the gutter 210 self-rights to the water collecting position, as described above.

Figure 17:
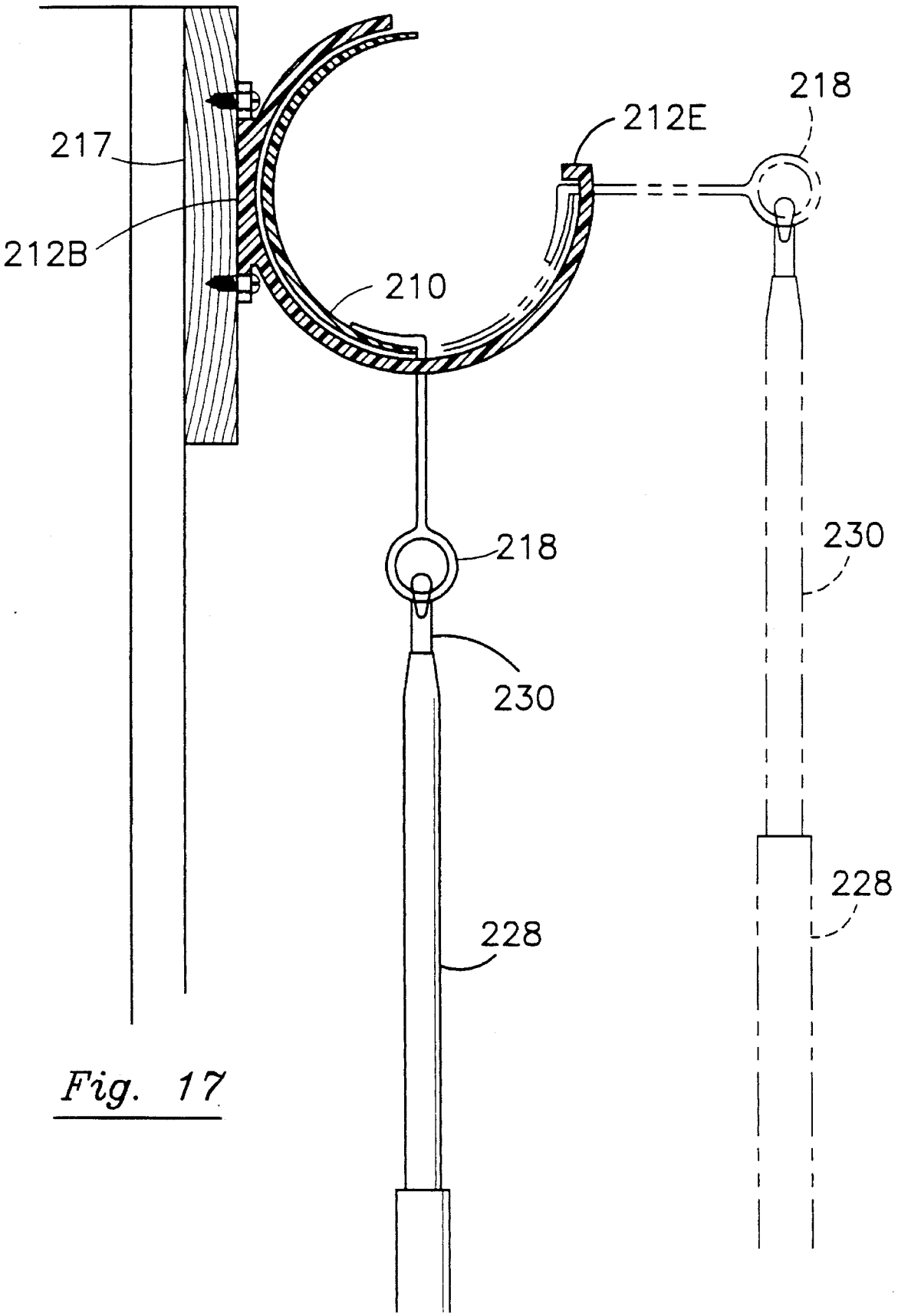
FIG. 17 is a side, partial cross-sectional view illustrating similar rotation of the gutter shown in FIG. 14 using a pole.

FIG. 17 shows another way of operating the gutter system 200. The cable 220 is replaced by a pole 228 having a hook 230. Normally, the gutter 210 is in a position to collect water. An operator standing on the ground places the hook 230 through a hook 218 in the gutter. Once the operator releases the pole 228, the weight of the pole causes the gutter 210 to rotate so that the gutter 210 may be cleaned. The pole 228 is properly weighted to rotate the gutter 210 without placing a great deal of stress on the gutter 210. By removing the hook 230 after cleaning, the gutter 210 self-rights to the water-collecting position.

Figure 18:
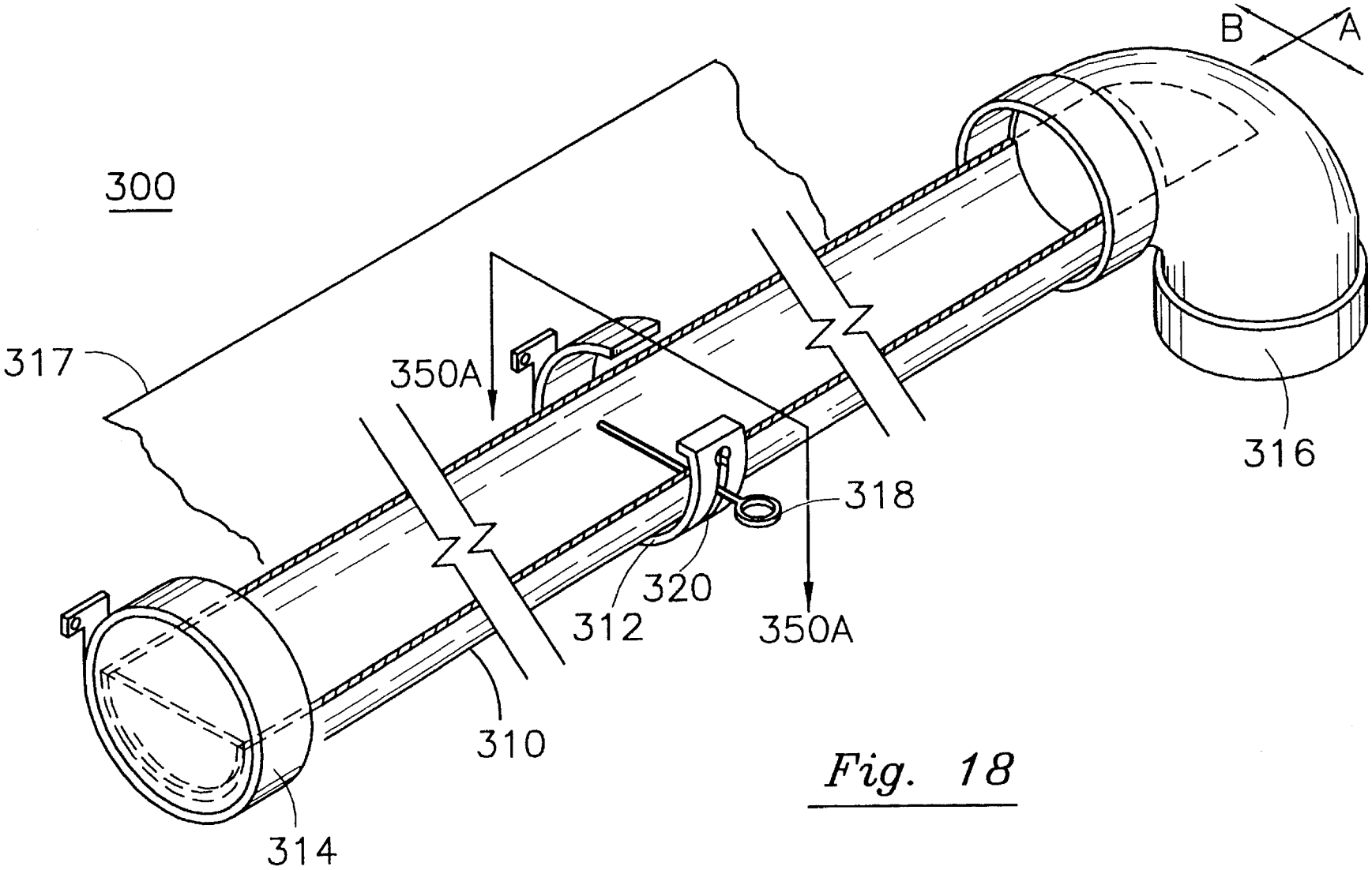
FIG. 18 is a perspective view of a fourth embodiment of the gutter system according to the present invention.

FIG. 18 is a perspective view of a fourth embodiment of the self-righting gutter system 300. As shown therein, a gutter 310 is supported, for example, by a support 312 placed intermediately of the ends of the gutter 310. The elbow 316 may be opened or closed as shown in phantom lines in FIG. 18. The gutter 310 is identical to the gutters 10, 110 and 210 of the first, second and third embodiments of the present invention. The end stop 314 and the elbow 316 prevent the gutter 310 from sliding along axis A. The end stop 314 is the same as the end stop 214 in the third embodiment. The gutter 310, intermediate support 312 and elbow 316 may be manufactured from PVC, plastic or any other weather resistant material. The support 312, end stop 314 and elbow 316 may be attached under the roof of a structure 317 using anchors, nails, screws, etc. A hook 318 is embedded in the gutter 310 as shown in FIG. 18. A cable or a pole may be used to rotate the gutter as in the first, second and third embodiments of the present invention.

Figure 19:
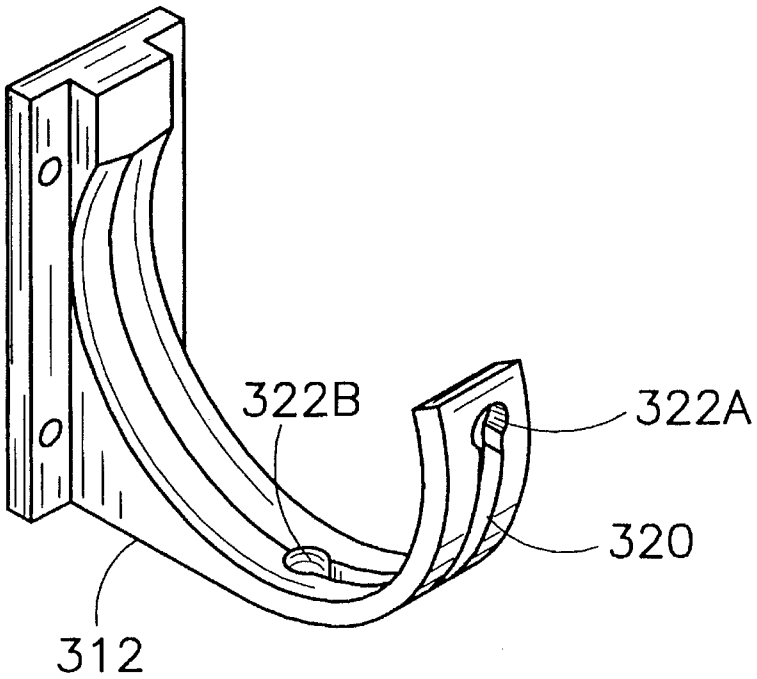
FIG. 19 is a cross-sectional view of a fourth embodiment of an intermediate support taken along line 350A—350A of FIG. 18 (gutter and hook are not shown).

As shown in FIGS. 18–19, the support 312 has a slot 320 and securing slots 322A–322B. The width of the slot 320 may decrease as the hook 318 moves closer to the securing slots 322A–322B. Thus, hook 318 is "pinched" into one of securing slots 322A–322B. The hook 318 is secured to the securing slots 322A–322B because the slot 320 at the opening of the securing slots 322A–322B is smaller in width than the diameter of the hook 318. If pressure is applied on the hook 318 by a rope or a pole (not shown), the hook 318 moves to the securing slots and the gutter 310 moves to the water catching or the cleaning position.

Although only one support 312 is shown in FIG. 18, more than one support 312 may be used depending upon the length of the gutter 310. In addition, supports 212 (not shown) may be used in addition to support 312 depending upon the length of the gutter 310. Further, although a support 312 having two security slots 322A and 322B is preferable, the support 312 may have zero securing slots or one securing slot.

Figure 20:
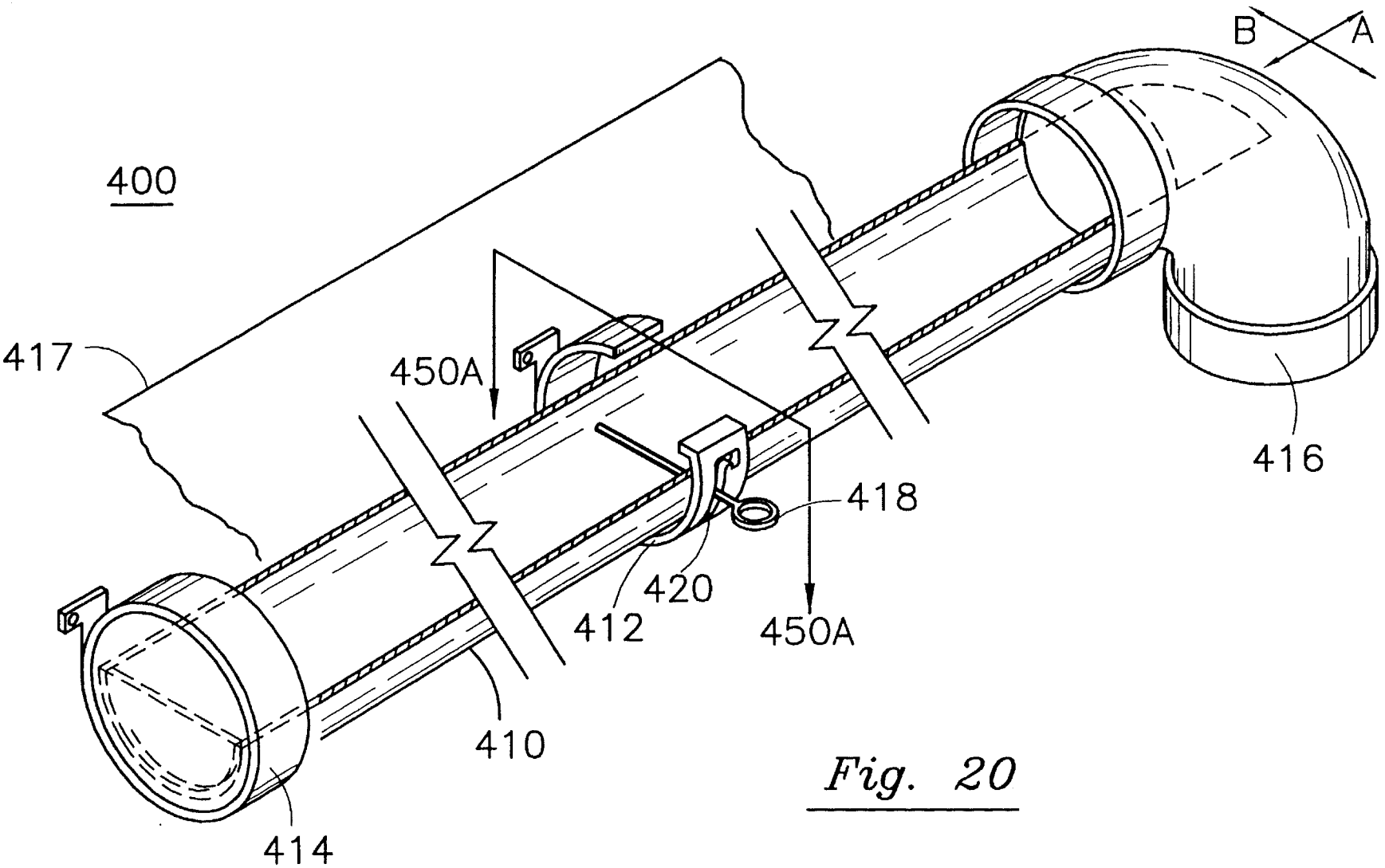
FIG. 20 is a perspective view of a fifth embodiment of the gutter system according to the present invention.

FIG. 20 is a perspective view of a fifth embodiment of the self-righting gutter system 400. As shown therein, a gutter 410 is supported, for example, by a support 412 placed intermediately of the ends of the gutter 410. The elbow 416 may be opened or closed as shown in phantom lines in FIG. 18. The gutter 410 is identical to the gutters 10, 110, 210 and 310 of the first, second, third and fourth embodiments of the present invention. The end stop 414 and the elbow 416 prevent the gutter 410 from sliding along axis A. The end stop 414 is the same as the end stop 214 in the third embodiment. The gutter 410, intermediate support 412 and elbow 416 may be manufactured from PVC, plastic or any other weather resistant material. The support 412, end stop 414 and elbow 416 may be attached under the roof of a structure 417 using anchors, nails, screws, etc. A hook 418 is embedded in the gutter 410 as shown in FIG. 20. A cable or a pole may be used to rotate the gutter as in the first, second and third embodiments of the present invention.

Figure 21:
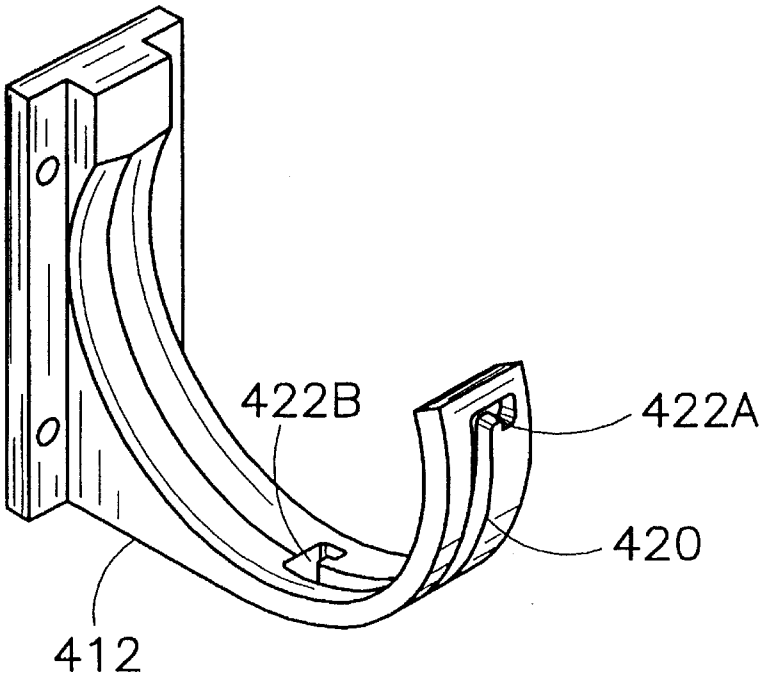
FIG. 21 is a cross-sectional view of a fifth embodiment of an intermediate support taken along line 450A—450A of FIG. 20 (gutter and hook are not shown).

As shown in FIGS. 20–21, the support 412 has a slot 420 and side securing slots 422A–422B. The hook 418 is secured to the securing slots 422A–422B by moving the hook 418 to the end of the slot 420 and moving the hook horizontally into the securing slots 422A–422B. If pressure is applied on the hook 418 by a rope or a pole (not shown), the hook 418 moves to the side securing slots and the gutter 410 moves to the water catching or the cleaning position.

Although only one support 412 is shown in FIG. 20, more than one support 412 may be used depending upon the length of the gutter 410. In addition, supports 212 (not shown) may be used in addition to support 412 depending upon the length of the gutter 410. Further, although a support 412 having two side security slots 422A and 422B is preferable, the support 412 may have zero side securing slots or one side securing slot.

While the invention has been illustrated and described in detail in the drawings and foregoing description, it will be recognized that many changes and modifications will occur to those skilled in the art. It is therefore intended, by the appended claims, to .cover any such changes and modifications that fall within the true spirit and scope of the invention.

I claim:

1. A self-righting gutter system for a structure comprising:

a gutter having edges, a center and a thickness which decreases from the center to the edges;

a support connected to the structure for supporting the gutter;

means for rotating the gutter from a first water collecting position to a second cleaning position; and means for self-righting the gutter to the first position.

2. A self-righting gutter system for a structure, comprising:

an elongated gutter having a curved, transverse cross section with edges, a center and a weight, which decreases from the center to the edges, said gutter being capable of movement between a first water collecting position and a second cleaning position;

a curved support connected to the structure and supporting the gutter, wherein the curve of the gutter and the curve of the support substantially correspond; and means, connected to the gutter, for rotating the gutter from the first position to the second position, wherein, when the means is removed, the weight at the center of the gutter causes the gutter to return to the first position.

3. The self-righting gutter system for the structure as in claim 2, wherein the support is a plurality of intermediate supports.

4. The self-righting gutter system for the structure as in claim 2, wherein the support includes an end stop, elbow and downspout to prevent movement along an axis.

5. The self-righting gutter system for the structure as in claim 2, wherein the support includes a T member and downspout.

6. The self-righting gutter system for the structure as in claim 2, wherein the support includes at least one stop.

7. The self-righting gutter system for the structure as in claim 2, wherein the support has a substantially curved section.

8. The self-righting gutter system for the structure, as in claim 2, wherein the support has a middle having a first thickness and the support has edges having a second thickness, wherein the first thickness is greater than the second thickness to form a triangular cross section upon which the gutter rests.

9. The self-righting gutter system for the structure as in claim 2, wherein the support includes a curve section having a protrusion upon which the gutter rests, said protrusion reducing friction during rotation of the gutter.

10. The self-righting gutter system for the structure as in claim 2, wherein the support includes an end stop, elbow, down spout and corner to prevent movement along an axis.

11. The self-righting gutter system for the structure as in claim 2, wherein the gutter has a semicircular cross-section and the support has a substantially curved section, which is adapted to receive the gutter.

12. The self-right gutter system for the structure as in claim 2, wherein the support has a circular cross-section.

13. A gutter system for a structure, comprising:

an elongated gutter, having a first edge, a second edge, a center and a weight which decreases from the center to the edges;

a support connected to the structure and supporting the gutter;

a connector mounted to the gutter; and a cable connected to the connector to rotate the gutter, wherein the cable is pulled to rotate the gutter from a first position to a second position for cleaning, and released for returning the gutter from the second position to the first position, and wherein the greater weight at the center gutter returns the gutter to the first position.

14. A self-righting gutter system for a structure, comprising:

an elongated gutter, having a first edge, a second edge, a center between the edges and along the longitudinal axis, and a thickness which decreases from the center to the edges;

a support connected to the structure and supporting the gutter;

a connector mounted to the gutter; and a pole coupled with the connector to rotate the gutter from a first position to a second position for cleaning, and uncoupled for returning the gutter to the first position, wherein the first position is a water-collecting position and the second position is a cleaning position.

15. A self-righting gutter system for the structure as in claim 2, wherein the curved support has a slot and at least one securing slot.

16. A self-righting gutter system for the structure as in claim 2, wherein the curved support has a slot and at least one side securing slot.

17. A gutter system for a structure, comprising:

an elongated gutter, having a first edge, a second edge, a center and a weight which decreases from the center to the edges;

a support connected to the structure and supporting the gutter;

a connector embedded in the gutter; and a cable connected to the connector to rotate the gutter, wherein the cable is pulled to rotate the gutter from a first position to a second position for cleaning, and released for returning the gutter from the second position to the first position, and wherein the greater weight at the center gutter returns the gutter to the first position.

18. A self-righting gutter system for the structure as in claim 17, wherein the curved support has a slot and at least one securing slot.

19. A self-righting gutter system for the structure as in claim 17, wherein the curved support has a slot and at least one side securing slot.

20. A self-righting gutter system for a structure, comprising:

an elongated gutter, having a first edge, a second edge, a center between the edges and along the longitudinal axis, and a thickness which decreases from the center to the edges;

a support connected to the structure and supporting the gutter;

a connector embedded in the gutter; and a pole coupled with the connector to rotate the gutter from a first position to a second position for cleaning, and uncoupled for returning the gutter to the first position, wherein the first position is a water-collecting position and the second position is a cleaning position.

21. A self-righting gutter system for the structure as in claim 20, wherein the curved support has a slot and at least one securing slot.

22. A self-righting gutter system for the structure as in claim 20, wherein the curved support has a slot and at least one side securing slot.

* * * * *

UNITED STATES PATENT AND TRADEMARK OFFICE

CERTIFICATE OF CORRECTION

PATENT NO. : 5,526,611

DATED : June 18, 1996

INVENTOR(S) : Kevin N. Leahy

It is certified that error appears in the above-indentified patent and that said Letters Patent is hereby corrected as shown below:

Column 7

Claim 1, line 1, delete "for" and insert --connected to--; and after "structure" insert --, the self-righting gutter system--;

line 4, after "support" insert --,--; and after "structure" insert --,--.

Column 8

Claim 2, line 1, delete "for" and insert --connected to--, and after structure, insert --the self-righting gutter system--.

Claims 3-12, line 1, delete "for" and insert --connected to--.

Columns 8, 9 & 10

Claims 13, 14 and 20, line 1, delete "for" and insert --connected to-- and after structure, insert --the gutter system--.

Claims 15-16, line 1, delete "for" and insert --connected to--.

Claims 18-19, line 1, delete "for" and insert --connected to--.

Claims 21-22, line 1, delete "for" and insert --connected to--.

Signed and Sealed this

Nineteenth Day of November, 1996

Bruce Lehman

*Attest:*

BRUCE LEHMAN

*Attesting Officer*

*Commissioner of Patents and Trademarks*